US007537456B2

(12) United States Patent
Snow

(10) Patent No.: US 7,537,456 B2
(45) Date of Patent: May 26, 2009

(54) WAGERING GAME WITH TABLE BONUS

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 326 days.

(21) Appl. No.: 11/196,550

(22) Filed: Aug. 2, 2005

(65) Prior Publication Data

US 2005/0269783 A1 Dec. 8, 2005

Related U.S. Application Data

(63) Continuation of application No. 10/286,440, filed on Oct. 31, 2002, now Pat. No. 6,923,446.

(51) Int. Cl.
*A63F 1/00* (2006.01)

(52) U.S. Cl. ..... 434/292

(58) Field of Classification Search ..... 273/274, 273/292, 303, 309; 463/13
See application file for complete search history.

(56) References Cited

U.S. PATENT DOCUMENTS 3,667,757 A 6/1972 Holmberg
3,876,208 A 4/1975 Wächtler et al.
3,939,953 A 2/1976 Miyazawa
4,305,586 A 12/1981 Richards
4,593,904 A 6/1986 Graves
4,651,997 A 3/1987 Wood
4,652,998 A 3/1987 Koza et al.
4,659,087 A 4/1987 Shen et al.
4,743,022 A 5/1988 Wood
4,756,531 A 7/1988 DiRe et al.

(Continued)

FOREIGN PATENT DOCUMENTS

EP 0 443 420 A2 8/1991

OTHER PUBLICATIONS

Smith, C., "Bar Bosses See New Trivia Game Filling More Seats", *The Vancouver Sun*, 1 page (Feb. 21, 1990).

(Continued)

*Primary Examiner*—Kurt Fernstrom
(74) *Attorney, Agent, or Firm*—Mark A. Litman & Associates, PA

(57) ABSTRACT

A method of playing a casino table wagering game with at least two players comprises wagering on an underlying game where players may receive a bonus for obtaining a player hand of at least a predetermined rank; placing a side bet that at least one player of the at least two players will obtain a player hand of at least a predetermined rank; playing a hand of the casino table wagering game to conclusion; determining if at least one of the at least two players has obtained a player hand of said at least a predetermined rank; if a player has not obtained a player hand of at least a predetermined rank, but that player has placed the side bet that at least one player of the at least two players will obtain a player hand of at least a predetermined rank, and if another player has obtained a player hand of at least a predetermined rank, awarding that player a predetermined proportional share of the bonus for obtaining a player hand of at least a predetermined rank.

23 Claims, 2 Drawing Sheets

U.S. PATENT DOCUMENTS

| | | | | |
|---|---|---|---|---|
| 4,807,884 | A | | 2/1989 | Breeding |
| 4,813,675 | A | | 3/1989 | Greenwood |
| 4,836,546 | A | | 6/1989 | DiRe et al. |
| 4,836,553 | A | | 6/1989 | Suttle et al. |
| 4,837,728 | A | | 6/1989 | Barrie et al. |
| 4,842,276 | A | | 6/1989 | Darby |
| 4,861,041 | A | | 8/1989 | Jones et al. |
| 4,882,473 | A | | 11/1989 | Bergeron et al. |
| 4,906,005 | A | | 3/1990 | Manabe |
| 4,948,134 | A | | 8/1990 | Suttle et al. |
| 5,019,973 | A | | 5/1991 | Wilcox et al. |
| 5,022,653 | A | | 6/1991 | Suttle et al. |
| 5,042,635 | A | | 8/1991 | Bell |
| 5,042,818 | A | | 8/1991 | Weingardt |
| 5,078,405 | A | | 1/1992 | Jones et al. |
| 5,098,107 | A | | 3/1992 | Boylan et al. |
| 5,100,137 | A | | 3/1992 | Fulton |
| 5,112,060 | A | | 5/1992 | Jones |
| 5,114,155 | A | | 5/1992 | Tillery et al. |
| 5,116,055 | A | | 5/1992 | Tracy |
| 5,154,429 | A | | 10/1992 | LeVasseur |
| 5,167,413 | A | | 12/1992 | Fulton |
| 5,248,142 | A | | 9/1993 | Breeding |
| 5,275,400 | A | | 1/1994 | Weingardt et al. |
| 5,275,415 | A | | 1/1994 | Wisted |
| 5,288,077 | A | | 2/1994 | Jones |
| 5,288,081 | A | | 2/1994 | Breeding |
| 5,326,104 | A | | 7/1994 | Pease et al. |
| 5,364,104 | A | | 11/1994 | Jones et al. |
| 5,382,025 | A | | 1/1995 | Sklansky et al. |
| 5,393,067 | A | | 2/1995 | Paulsen et al. |
| 5,417,430 | A | | 5/1995 | Breeding |
| 5,437,462 | A | | 8/1995 | Breeding |
| 5,472,194 | A | | 12/1995 | Breeding et al. |
| 5,544,892 | A | | 8/1996 | Breeding |
| 5,630,586 | A | | 5/1997 | Lowden |
| 5,669,817 | A | | 9/1997 | Tarantino |
| 5,743,800 | A | | 4/1998 | Huard et al. |
| 5,769,422 | A | | 6/1998 | Stromer |
| 5,820,460 | A | | 10/1998 | Fulton |
| 5,848,932 | A | | 12/1998 | Adams |
| 5,851,011 | A | | 12/1998 | Lott |
| 5,901,958 | A | | 5/1999 | Andrews |
| 5,941,769 | A | | 8/1999 | Order |
| 5,957,459 | A | | 9/1999 | Chae |
| 5,979,897 | A | | 11/1999 | Grossman |
| 5,984,309 | A | | 11/1999 | Santin |
| 5,984,310 | A | | 11/1999 | English |
| 5,988,643 | A | | 11/1999 | Awada |
| 5,997,002 | A | * | 12/1999 | Goldman ..... 273/292 |
| 6,012,719 | A | | 1/2000 | Webb |
| 6,019,374 | A | | 2/2000 | Breeding |
| 6,036,190 | A | | 3/2000 | Edmunds et al. |
| 6,102,402 | A | * | 8/2000 | Scott et al. ..... 273/292 |
| 6,126,166 | A | | 10/2000 | Lorson et al. |
| 6,237,916 | B1 | | 5/2001 | Webb |
| 6,273,424 | B1 | | 8/2001 | Breeding |
| 6,313,871 | B1 | | 11/2001 | Schubert |
| 6,454,266 | B1 | * | 9/2002 | Breeding et al. ..... 273/292 |
| 6,481,717 | B1 | * | 11/2002 | Richardelle ..... 273/292 |
| 6,659,461 | B2 | * | 12/2003 | Yoseloff et al. ..... 273/274 |
| 6,692,003 | B2 | * | 2/2004 | Potter et al. ..... 273/274 |
| 6,712,360 | B2 | * | 3/2004 | Yaple ..... 273/292 |
| 6,776,415 | B2 | * | 8/2004 | Robinson et al. ..... 273/292 |
| 7,165,770 | B2 | * | 1/2007 | Snow ..... 273/292 |
| 7,195,243 | B2 | * | 3/2007 | Kenny et al. ..... 273/292 |

OTHER PUBLICATIONS

Scarne, Jr., "Scarne's Encyclopedia of Games", *Harper & Row Publishers, First Edition*, Stud Poker, pp. 33-41, 1973.

Scarne, "Scarne's Guide to Modern Poker", Constable and Company Limited, 1979, "Pokino", pp. 160-162.

"Wild Deuces", *Michigan Legionaire*, vol. XXXII, No. 10, 1 page, (Oct. 1978).

Gros, R., "Working Within the Systems", *Casino Journal*, vol. 8, No. 12, pp. 10-11,13, 15, 4 (Dec. 1992).

"Second Amended Petition filed in the Civil Action In the Matter of the Petition of IGT for Certain Declaratory Rulings and for the Authorization for the Implementation of the Game of Progressive-21". pp. 1-9 (1992).

"Over/Under 13 Blackjack", Product Brochure Published by Gaming Concepts, Inc., 3 pages (1988).

"Declaration of Jim Kilby Under 37 CFR 1.132", 2 pages (May 9, 1995).

"Wheel of Gold", Product Information published by Anchor Games, 11 pages (Oct. 1995).

John Scarne Games Inc., *Scarne's Guide to Modern Poker*, 1980, Draw Poker Variation of Spit in the Ocean, pp. 139-153.

"Poker is the name of the Game", Walter Gibson, 1974, Chapter VIII, Spit in the Ocean (not clarly readable).

"Hoyle's Modern Encyclopedia of Card Games", Walter Gibson, 1993, pp. 268-271. (not clearly readable).

"Hoyle's Rules of Games, 2d Revised Edition" Morehead and Mott-Smith pp. 34-63, 1983.

* cited by examiner

WAGERING GAME WITH TABLE BONUS

RELATED APPLICATION DATA

This Application is a continuation of U.S. patent application Ser. No. 10/286,440, filed Oct. 31, 2002, now U.S. Pat. No. 6,923,446 issued Aug. 2, 2005.

BACKGROUND OF THE INVENTION

1. Field of the Invention

The present invention relates to playing card wagering games that can be played with playing cards, including a standard deck(s) of cards or by video machine technology, particularly in a casino environment. In particular, it relates to a method and apparatus for playing a wagering game, wherein the game includes bonus awards for predetermined card combinations, hands or ranks to a player, and where all players at the table have an option at the beginning of the game to place a side bet to participate in all awards to any player for obtaining such predetermined card combinations or hand ranks.

2. Background of the Art

There are many wagering games used for gambling. Such games should be exciting to arouse players' interest and uncomplicated so they can be understood easily by a large number of players. Ideally, the games should include more than one wagering opportunity during the course of the game, yet be able to be played rapidly to a wager resolving outcome. Exciting play, the opportunity to make more than one wager and rapid wager resolution enhance players' interest and enjoyment because the frequency of betting opportunities and bet resolutions is increased.

Wagering games, particularly those intended primarily for play in casinos, should provide players with a sense of participation and control, the opportunity to make decisions, and reasonable odds of winning, even though the odds favor the casino, house, dealer or banker. The game must also meet the requirements of regulatory agencies.

Wagering games, including wagering games for casino play, with multiple wagering opportunities are known. U.S. Pat. Nos. 4,861,041 and 5,087,405 (both to Jones et al.) disclose methods and apparatus for progressive jackpot gaming, respectively. The former patent discloses that a player may make an additional wager at the beginning of a hand, the outcome of the additional wager being determined by of a predetermined arrangement of cards in the player's hand. U.S. Pat. No. 4,836,553 (to Suttle and Jones) discloses a modified version of a five card stud poker game.

Additional symbols may be added to the usual means of playing a game to increase wagering opportunities. This is disclosed in U.S. Pat. No. 5,098,107 (to Boylan et al.). Somewhat similarly, U.S. Pat. No. 3,667,757 (to Holmberg) discloses a board game and apparatus, including a way to allow the player to make a choice with respect to several different alternative types of game play and risk bearing strategies. The alternative play is based on providing cards with additional symbols and therefore, a new set of odds. The game and apparatus disclosed by Holmberg requires new sets of rules, relatively complicated procedures and time for a player to learn the game.

U.S. Pat. No. 5,154,429 (to LeVasseur) involves the dealer playing multiple hands against a player's single hand, whereby the number of hands played in the same amount of time is increased.

U.S. Pat. No. 5,288,081 (Breeding) describes the game Let It Ride® stud poker which is played in many casinos around the world. That wagering game is played with a single, typical (standard) fifty-two card poker deck and broadly involves the generally well recognized and accepted set of rules, procedures and wager-resolving outcomes of five card poker. The game method comprises each player placing an initial, three-part wager to participate in the game. A separate bonus wager (a side bet wager) may be placed to play against a pay table. Cards are dealt by a dealer, three down to each player and two down to the dealer. Players inspect or "sweat" their cards, and the dealer asks "take it or leave it?" or as the name of the game implies, "Let It Ride®?" with regard to the first part of the initial bet. Players can choose to retrieve or remove from play the first part of their initial bet, or leave the first part in play or at risk, based on the value of the three cards in their hand. The side wager or bonus wager cannot be withdrawn and is immediately withdrawn by the house in the play of the game. The dealer then turns over one of the dealer's cards and the dealer's query is repeated with regard to the second part of the initial bet. Players can choose to retrieve or remove from play the second part of their initial bet or leave the second part in play or at risk, based on the value of the four cards consisting of the three cards in the player's hand and the exposed dealer's card. Players have no option with the third part of the bet. Finally, all cards are shown and the payouts and collections are resolved according to the ranking of the poker hand of each player, i.e., the players are not playing against each other or the dealer.

Another element of play in casino games and particularly casino table card games in the wagering structure. There are a multitude of card games that are based on one or more decks of conventional playing cards. Among the most popular of these games is poker, wherein a player's fortunes are determined by a well-known hierarchy of card combinations. Card games that are variants of poker are also very popular, such as Let It Rides® stud poker, Caribbean Stud™ poker, Three Card™ poker and the like. This is due, at least in part, to the basic nature of the underlying game itself, combining elements of both strategy and luck. Additionally, poker-variants allow an existing player-base to capitalize on their preexisting knowledge of a game and to apply that knowledge in novel settings. The two most popular forms of traditional poker are draw poker and stud poker.

In a conventional hand of draw poker, a single 52-card deck of shuffled playing cards is used. Each player begins a hand by contributing an initial or "ante" bet to a common pool or "pot", the pot ultimately going to the owner of the winning hand. The dealer then distributes five face-down cards to each player, the remaining cards in the deck being set aside for later use. Each player evaluates the cards that he or she has been dealt and each, in turn, is given an opportunity to discard one or more cards from the dealt hand. The dealer gives the player replacement cards for those that have been discarded by dealing additional cards face-down from the top of the deck. Following the deal, one or more rounds of betting take place, during which time each player may make an initial raise, a check wager, fold (drop-out), match a previous raise or raise a previous bet. The meanings of these wagering terms are well know to those skilled in the art and typical definitions of same may be found in, for example, *Hoyle's Rules of Games*, pp. 75-102, by Morehead and Mot-Smith, 1963, the disclosure of which is incorporated herein by reference. At the conclusion of the wagering rounds, the players display their hands and the holder of the highest ranking poker hand takes all of the money in the pot.

Stud poker is the most popular form of "open poker," wherein each player is dealt some cards that are face-up and, hence, available for viewing by the other players. Stud poker comes in two varieties: 5-card and 7-card, the two being of approximately equal popularity. In five-card stud poker, the dealer gives each player a face-down (or "hole" card) and then a face-up card. Thus, at the start each player knows his own two cards and one card of each of his opponents. After the first two cards are dealt, a wagering round ensues, during which time each player contributes his or her wager to the pot. A typical description of the rules that govern this round might be found in, for example, Hoyle's Rules of Games, pp. 75-102, by Morehead and Mot-Smith, 1963, the disclosure of which is incorporated herein by reference. After the wagering round, another card is dealt face-up to each player. This is followed by another wagering round. Alternating dealing and wagering rounds continue until each player has a total of five cards: four face-up and a concealed hole card. After the final bets have been placed, each player who has not dropped out during the deal/wager rounds reveals his or her hole card. The owner of the highest ranking 5-card poker hand wins and takes whatever amount is in the pot.

Seven-card stud poker differs slightly from 5-card poker. First, in 7-card poker each player initially receives two cards face-down and one card face-up. A bidding round then ensues. The dealer then gives each player another face-up card, which is followed again by a bidding round. Deals (of one face-up card) and bids are alternated until each player has four face-up cards and two face-down cards. Finally, a third face-down card is dealt to each player (making a total of seven cards). This is followed by a last bidding round. The winner of the hand is the player who can form the highest ranking 5-card poker hand from his seven cards.

As is well known to those skilled in the art, five-card poker hands are ranked from "Royal Flush" (highest) to "High Card(s) in Hand" (lowest) according to the following ordering:

| Hand | Description | Example |
|---|---|---|
| Royal Flush | The five top cards of a suit | A, K, Q, J, 10 (suited) |
| Straight Flush | Five cards in sequence in the same suit | e.g., 5, 6, 7, 8, 9 (suited) |
| Four of a Kind | Any four cards of the same rank, | e.g., 2, 2, 2, 2, J |
| Full House | Three of a kind and a pair | 2, 2, 2, J, J |
| Flush | Five cards of the same suit | 2, 4, 8, 10, A (suited) |
| Straight | Five cards in sequence | 6, 7, 8, 9, 10 (unsuited) |
| Three of a Kind | Three cards of the same rank | 2, 2, 2, 9, J |
| Two Pair | Two cards of the same rank and two others of a different rank | e.g., 2, 2, Q, Q, A (unsuited) |
| One Pair | Two cards of the same rank | e.g., 9, 9, 5, 8, K |
| High Card(s) in Hand | Five unmatched cards | A, 9, 5, 3, 2 (unsuited) |

In some variations of poker, the ace may also act as the lowest card in the deck to form a straight when used in a sequence like A, 2, 3, 4. Additionally, a "wild card"—often the "joker" card may be designated, so that a person who holds that card may declare its value to be that of any card in the deck, the presumption being that the declared card value will help that player form a better poker hand.

At its core, poker is a vehicle for gambling. Commonly the quantities wagered are monetary, but that is not strictly required and poker chips, matches, and other non-pecuniary tokens have been used in place of money to help the players determine who is winning without exposing them to financial loss. Of course, casinos are in the business of providing people with the opportunity to gamble and, given the popularity of poker among the general populous, it only stands to reason that casinos would desire to offer this game in some form or another to those who seek to play it. However, conventional-rules poker is not particularly well suited for use in a casino.

A casino that offers traditional poker to its clientele typically does so by providing a dealer and a room in which to play, but the casino's dealer does not actually participate in the game as a player: his or her function is just to distribute the cards and referee the game. The casino makes its money by taking some percent of all of the money wagered (the "rake") or by leasing the room to the participants. The cost of the lease may be measured in time (e.g., a fixed amount per hour) or by a count of the number of hands played. Traditional poker games are not particularly favored by casinos because the casino does not make as much money acting as a landlord as it would if it were an active participant in the game.

Similarly, from the standpoint of the gaining public, traditional poker has some disadvantages which have tended to make it less desirable as a casino game. First, traditional poker is readily available "at home," e.g., at the Friday night poker session, and there is no particular need for most people to travel to a casino to play it. Second, when an individual wins at traditional poker it is at the expense of the other players/participants. Many people prefer to play against the "house" (i.e., the casino) so that their winning hand does not necessarily result in a loss by a fellow player, who may be an acquaintance. Finally, traditional poker does not offer the excitement associated with "jackpot" type games. That is, a royal flush in traditional poker—as improbable as that card combination is—will result in winning only the amount in the pot and nothing more. Many players seek out games where there is some possibility of "winning big," an option that is not available under conventional poker rules.

As a consequence of these disadvantages, casinos have introduced a variety of poker-type game variants to address the shortcomings discussed previously. One obvious advantage of these poker-type games from the casino's point of view is that the casino becomes an active participant in the game (as the house) and can, as a consequence, increase the revenue taken from the game. Additionally, these poker-type games are very attractive to many of the gambling public, and the mere fact that they are available in a particular casino has the potential to increase consumer traffic and revenue there.

A variety of innovative stratagems have been employed to make poker-type games more appealing to casino gamblers. For example, many poker-variants are designed to let the players compete against the house, rather than against each other. In other cases, progressive betting has been utilized, wherein the player may increase his or her bet during the play of a hand. This makes the game more exciting to the player and potentially more profitable for the casino. Jackpots have been introduced, wherein certain card combinations in the player's hand result in an enhanced payout to that player. Finally, computer implementations of these games is always an attractive possibility, with video based casino games becoming increasingly popular. One such video implementation of a poker-type game is taught by Weingardt, U.S. Pat. No. 5,042,818. Of course, a natural next step is to offer these same video based casino games over the Internet, thereby making the games available to a potentially enormous audience. The most successful casino table poker games to date are Let It Ride® stud poker (as originally described in U.S.

Pat. No. 5,288,081), Caribbean Stud™ poker (originally described in U.S. Pat. No. 4,836,533), and Three Card™ poker (as described in U.S. Pat. No. 6,237,916).

In most casinos, a game of blackjack begins by having each player place an initial wager. The blackjack dealer then distributes two cards face-down to each player and two cards—one face up and another face down—to him or herself. After the player has examined the two dealt cards and compared those cards with the face-up dealer's card, a number of options present themselves to the player. The player may "stand" (i.e., take no further cards), draw one or more additional cards in order to increase the numeric sum of the hand, double down (a form of progressive wagering), or split the two cards. Additionally, if the dealer's face-up card is an ace, the player may elect to buy insurance against the possibility that the dealer has a blackjack. If, after the dealer's face-down card is revealed, the dealer does not have a blackjack, the player loses the amount that was paid as insurance (although he or she may go on to ultimately win that deal). If, on the other hand, the dealer has a blackjack, the player collects double the amount of insurance bought (but may still lose the amount of the original wager). The option of purchasing insurance is unique to blackjack type games and has not, heretofore, been available in poker-style games. The broad rules of blackjack are generally known to those skilled in the art and a fuller description may be found in the materials previously incorporated by reference.

In addition to novel games being introduced into casinos, novel betting formats have also been introduced. Side bets have always been common in wagering environments, but the use of side bets for jackpots and bonuses in casino table card games was believed to have been first practiced by David Sklansky in about 1982 in a public showing of Sklansky's Poker in Las Vegas, Nev. The play and/or betting structure of Caribbean Stud™ poker was modeled after that game. Blackjack has allowed surrender play at many tables, where half the original wager is withdrawn and the other half is forfeit to the house at the election of the player. U.S. Pat. No. 5,820,460 (Fulton) describes a method for playing a casino table card game wherein wagers are changed after some cards are viewed by the player. Let It Ride® stud poker advanced that theory significantly as described in U.S. Pat. No. 6,273,424, where specific segments of wagers could be withdrawn from an original wager that was in multiple parts.

It is still beneficial to provide additional wagering formats and structures to add both interest to the game and better control over house retention and player awards.

The desired attributes of wagering games outlined above are in large measure provided by the method and apparatus for a wagering game in accordance with the present invention. The game is uncomplicated, exciting and provides the opportunity for players to make multiple wagers and choices regarding those wagers.

SUMMARY OF THE INVENTION

The wagering game of the present invention is played with at least a single standard fifty-two card poker deck and broadly involves the generally well recognized and accepted set of rules, procedures and wager-resolving outcomes of card games, especially five card poker and variations of five card poker. The table bonus wager and format of the present game is amenable to use with any casino table card game or video gaming equivalent where multiple players play at the same time against a pay table or against the house, and bonus awards are provided for hands or at least a predetermined rank. Each player has the option (before seeing sufficient cards to provide even a preliminary evaluation of the likelihood of winning) of placing a side bet wager that a player at the table will obtain a hand of a predetermined rank that will receive a bonus payout. This is called a table wager, community wager, group wager, or the like. The player may also make an optional individual wager that he/she will receive a hand of a predetermined rank that will receive a bonus payout.

The preferred game method played with this wagering format comprises Let It Ride® stud poker, and a new variant of that game where each player placing an initial, four-part wager (as opposed to the required three-part wager used in Let It Ride® stud poker) to participate in the game. Cards are dealt by a dealer, three down to each player and two down to the dealer. Players inspect or "sweat" their cards, and the dealer asks "take it or leave it?" or "Let It Ride®?" with regard to the first part of the initial bet. Players can choose to retrieve or remove from play the first part of their initial bet, or leave the first part in play or at risk, based on the value of the three cards in their hand. The dealer then turns over one of the dealer's cards and the dealer's query is repeated with regard to the second and third parts of the initial bet, except that withdrawal of the second part results in the house claiming the third part of the wager. This step requires that two parts (the second part and the third part) of the four-part bets (usually equal parts) be considered at the same time of play. Players can choose to retrieve or remove from play the second part and forfeit the third part of their initial bet or leave the second part and third part in play or at risk, based on the value of the four cards consisting of the three cards in the player's hand and the first exposed dealer's card. Players have no option with the fourth part of the bet, which is referred to as the contract wager, as it must remain in play through the conclusion of play of the game. Finally, all cards are shown and the payouts and collections are resolved according to the ranking of the poker hand of each player, i.e., the players are not playing against each other or the dealer.

The pay table in this game (to be marketed as "Dakota Stud™" table card game) can be adjusted from the pay tables in Let It Ride® poker to reflect the change in betting/wagering structure. For example, to compensate for the required forfeit of the third wager part if the second wager part is withdrawn, the qualifying hand for a win may be lowered from the pair of 10's ordinarily required to win against the pay table in Let It Ride® stud poker. For example, the minimum winning hand may be any pair, a pair of 2's, 3's, 4's, 5's, 6's, 7's, 8's or 9's. Additionally, higher odds may be paid on higher ranked hands to make play of the game more attractive to players. The game may also be modified to provide the player with five cards and the dealer with two hole cards or common cards, with the best five-card poker hand playing against a pay table, or with the player being dealt four cards, and the dealer receiving three cards. This may be done with the dealer having one of the three cards exposed immediately before consideration of withdrawal of the first part of the wager, or with three cards provided face down. In the latter circumstance, the dealer's face down cards may be exposed one-at-a-time, or preferably two at one time and one card at another time in the betting/wagering sequence. Two cards may be exposed before consideration of withdrawal of the second (and third) parts of the wager, or first one card exposed at this stage and then two cards exposed at the end of play, after withdrawal of the second and third parts has been considered and exercised.

More specifically, in the preferred play of the game the initial wager placed by each player comprises four equal parts and is made or placed before any cards are dealt. Each player is dealt three cards face down in the customary fashion. Two common cards are dealt face down in front of the dealer for use by all of the players. Each player will use the two common cards in front of the dealer in combination with his or her three cards to create a five card hand. After all players have placed their four wagers/bets (and in an optional play of the game, a special bonus wager or jackpot wager for extra or extraordinary awards for high ranking hands against a pay table) and received and examined their cards, each is given the opportunity to retrieve one part (if equal wagers are placed, that is one-fourth) of the initial wager before the dealer reveals one of the two down cards previously placed in front of him. After all of the players have been queried and decided whether to withdraw the first part of their wager, the dealer turns one of the down cards face up. Each player now has the benefit of four cards, the three he or she is holding down plus the common card, and the dealer again gives each player the opportunity to retrieve further part(s) of the initial wager, In this case, with equal wagers, the player has the option of leaving the second and third parts in play or withdrawing the second part and forfeiting the third part before exposing the second common down card. After the second common down card is revealed, the players turn up the three cards they are holding thereby forming five card hands made up of the three cards dealt to each player and the two dealer cards. The dealer examines each of the players hands and determines what payout, if any, each player is entitled to receive according to that players' remaining wager and a preselected payout schedule. Payouts are made to players with winning hands and the losing wagers are collected. The cards are then reshuffled for the next hand. Where a separate side bet has been placed as a bonus or jackpot wager (against a pay table and/or against a progressive jackpot), that wager must also be resolved.

Apparatus is disclosed for playing the wagering game according to the method outlined above. A typical gaming table, with a playing surface, is modified to include specific areas that provide locations for placing the wagers and for displaying the common cards. A card shuffling machine such as that disclosed in U.S. Pat. No. 4,807,884 or other shuffling machines manufactured by Shuffle Master Gaming, Inc. of Las Vegas, Nev. for facilitating and speeding the play of the wagering game may be used. A display device may be associated with the apparatus for displaying game information, shuffle status, or other information relevant to the dealer, the players or the house.

The present invention provides an exciting and interesting wagering game. The wagering game is easy to learn, largely being based on five card stud poker and the well known ranking of poker hands. The present invention provides a new variation of a well known wagering game, five card poker, and in particular Let It Ride® stud poker, which is made more interesting by providing the opportunity for players to make multiple wagers and decisions related to those wagers based on the progress of the game.

Still another aspect of the present invention is to provide a wagering game that is easy to learn, yet demands skill of players in making strategic decisions about whether to let part of their bet ride. It is yet another aspect of the present invention to provide a unique, exciting card game for play in casinos or at home and on various media including casino tables, video poker machines, video lottery terminals or home computers. It is an advantage of the game of the present invention that wagering decisions are inherent in the game. The game enhances players' sense of participation and takes advantage of players' inclination to let wagers ride once placed.

DETAILED DESCRIPTION OF THE INVENTION

Figure 1:
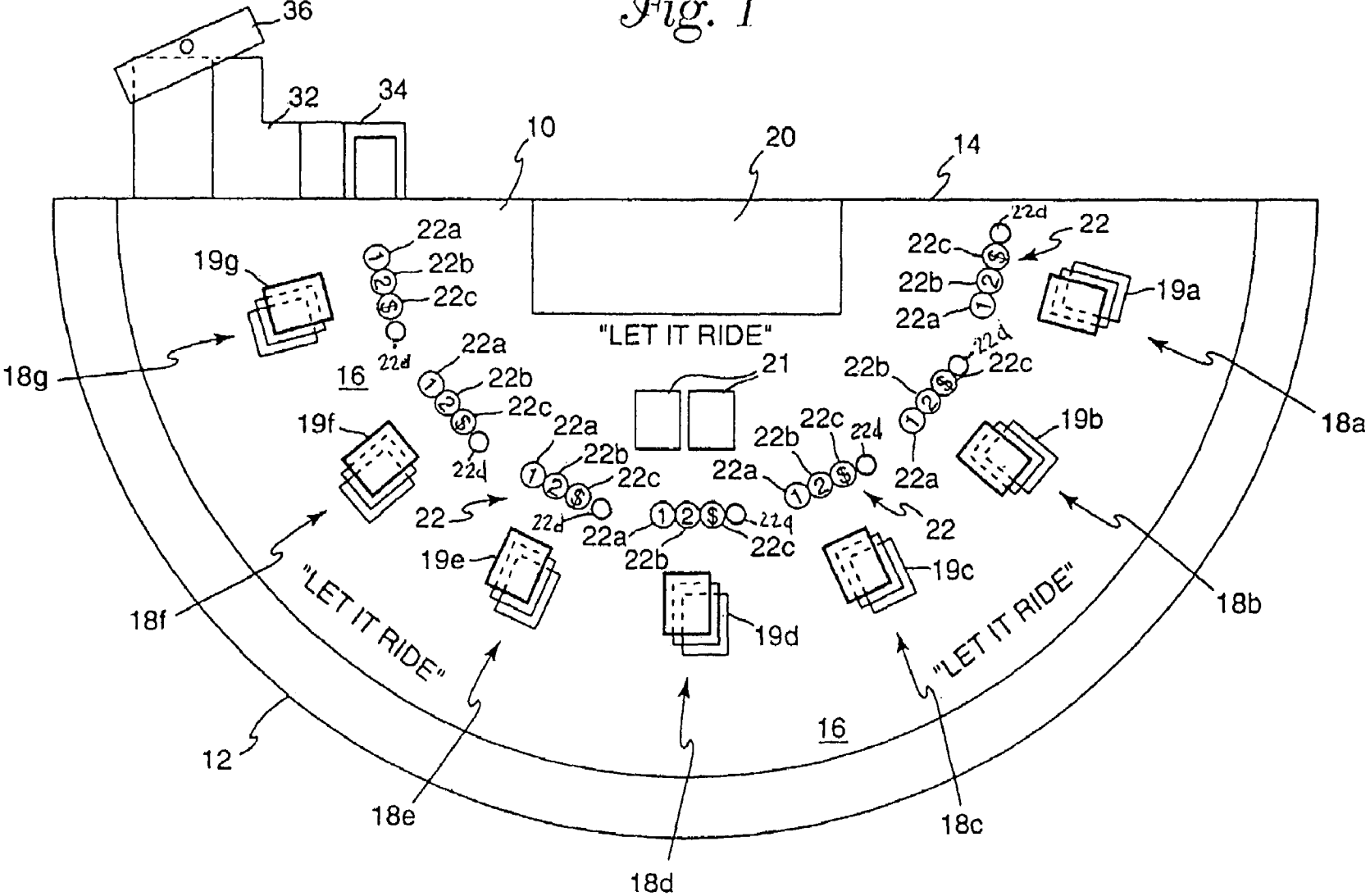
FIG. 1 depicts the table layout and apparatus used in playing the wagering game of the present invention.

Referring to FIG. 1, the apparatus for the wagering game of the present invention includes a typical casino gambling or gaming table 10. The table 10 has a curved side 12 for accommodating up to seven players and a straight side 14 for accommodating the dealer. The table 10 has a flat surface 16 covered with felt or other appropriate material. Although seven playing positions or locations 18*a-g* for individual players are provided, it is not essential to the game that exactly seven persons play and as many as sixteen players may participate. For casino play, a maximum of seven players provides for a game that is easily manageable by the dealer and house, and one in which the individual players feel more involved. A house dealer position 20, including an area suitable for displaying the dealer's cards 21, is provided.

Each of the playing positions 18*a-g* includes a wagering zone 22, comprising four separate and distinct wagering or betting areas 22*a, b, c, d*. A separate wagering area 22*e* may be provided for placing of a bonus or jackpot (e.g., progressive jackpot) wager. Each position 18*a-g* also includes a card area 19*a-g* for receiving and displaying cards dealt to the player occupying the position. The wagering areas 22*a, b, c, d* are designed to receive appropriate wagering indicators or settling means such as chips (not shown).

At one side of the dealer station 20, the apparatus for practicing the method of the present invention may include a microprocessor or computer controlled shuffling machine 32 supported by a table extension 34. The shuffling machine 32 may be of the type disclosed in U.S. Pat. No. 4,807,884 or any other single deck or multideck shuffling apparatus manufactured by Shuffle Master Gaming, Inc., the disclosure of which patent is incorporated herein by reference. The shuffling machine 32 may include a dealing module for automatically and sequentially dealing cards and also may include a display means for displaying wager amounts, the identity of winning players, or other game related information.

Figure 2:
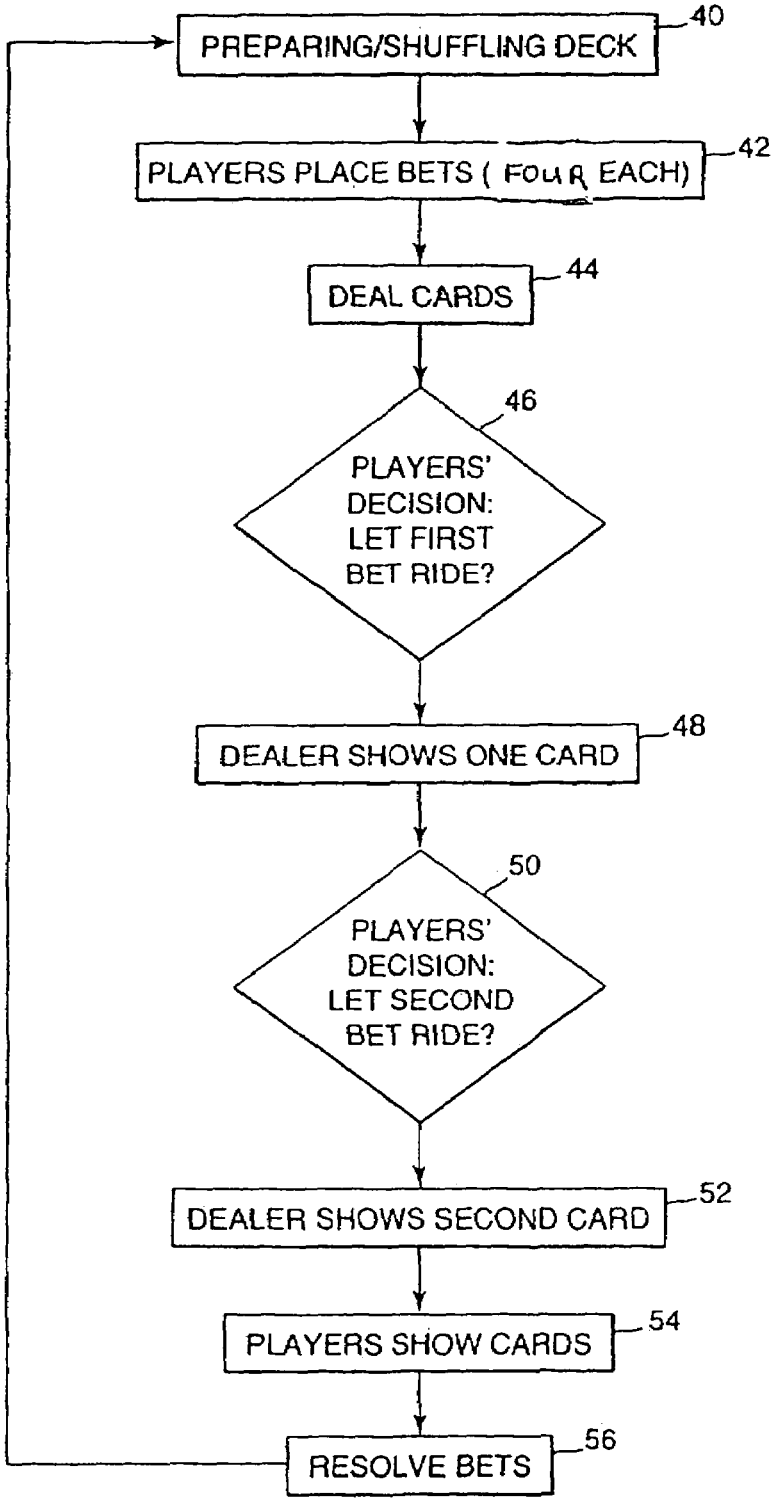
FIG. 2 is a block diagram representing the flow of play in the game.

Referring to the flow diagram of FIG. 2, the initial step in playing the game of the present invention is preparing or shuffling a deck of cards, represented at block 40, by activating the shuffling machine 32 or by hand-shuffling a deck to provide a shuffled deck. Next, the players place the initial wager, block 42, by putting equal amounts in each of the four betting areas 22*a, b, c, d*. Two of the parts of this initial wager, the parts placed in wagering area 22*a* and 22*b* are retrievable at the option of the player. The third portion placed in area 22*c* is a wager that is forfeited if the second wager at 22*b* is withdrawn. The fourth part 22*d* of the four part wager is a nonwithdrawable bet. After the placing of the wager by each player, the cards are dealt, block 44, preferably three cards being dealt down to each player and preferably two cards are dealt down in front of the dealer. The players inspect or "sweat" their cards in preparation for reaching decision block 46. At decision block 46, the players are queried by the dealer about whether the first part of the initial wager, the part placed in wagering area 22*a*, should be left or whether the player wishes to withdraw that portion of the bet. Each player makes the decision at decision block 46 on the basis of the three cards forming the player's incomplete hand at this point. Once each player has been queried and has decided whether or not to let the first portion of the bet ride, and those bets the player chooses to retrieve or remove are physically removed from area 22*a* and returned to the player, the dealer shows one of the down common cards, block 48. Now, each player has four cards to consider, the three cards dealt to that player originally and the single common card showing on the table. Each player must then decide whether to let the second part of the initial wager ride or whether to withdraw it from the game. As noted, if the second part of the wager is withdrawn, the third part of the wager is forfeit and is collected by the house. After each player is queried and decides what to do with regard to the second part of the bet, and those bets to be withdrawn are physically removed from area 22*b* (and 22*c* if the third part is forfeit) and returned to the player, the dealer reveals the second common down card, as represented at block 52. Each player now has a five card hand comprised of the three cards each player was originally dealt plus the two revealed common cards. The third bet, the bet placed at wagering area 22*d*, is a nonretrievable portion of the initial bet and the flow of the game proceeds to block 54 wherein the players show or reveal their three cards to the dealer. The dealer resolves each player's bet (which includes all three parts, the second and third part or only the third part, depending on the player's choices during play of the hand) based on the five card hand at block 56 and determines what payout, if any, the player is entitled to receive according to the payout schedule at the particular gaming table or casino. Bets on non-winning hands are collected by the dealer or house. The hand is then over and the flow of the game returns to block 40, preparing and shuffling the deck for a new hand.

The award or payoff is given for each of the optional bets that were allowed to ride to the end of the hand and for the non-withdrawable part of the bet. A typical pay table would be as follows:

| | | |
|---|---|---|
| Pair, Sixes or Better | 1-1 | (even money) |
| Two Pairs | 2-1 | |
| Three of a Kind | 3-1 | |
| Straight | 5-1 | |
| Flush | 8-1 | |
| Full House | 11-1 | |
| Four of a Kind | 50-1 | |
| Straight Flush | 200-1 | |
| Royal Flush | 1,000-1 | |

The method of the present invention is not limited to five card poker games, but may be applied or used in other appropriate games such as seven card poker, as described elsewhere herein. The method of the present invention does not require a shuffling machine 32, dealing module 33 or a display means 36. However, these facilitate and expedite the play of the game as well as add interest to the game. While the initial wager of the present invention is preferably comprised of four equal bets, the bets do not necessarily have to be equal. The second and third parts should be equal, or the third part may be smaller than or greater than the second part. Similarly, the first, second, third and fourth parts may be of different values, but the fourth bet must be at least equal to a table minimum and may be required to be at least equal to or greater than any other wager part. While equal bets are highly preferred for casino play, unequal bets may be used in home play, if desired. The wagering game of the present invention might be played live in casinos with a dealer, or in casinos or homes in interactive electronic or video form with automatic coin or betting means receptacles and payout capability, wherein appropriate symbols for cards, wagers or score keeping would be displayed electronically. A "board-type game" suitable for home, club or casino use may also be provided for practicing the method of the present invention.

In combination with or separate from the play of Dakota Stud™ casino table poker, a new wagering structure resulting in different bonus structures may be used. The pure wagering structure described above, where the third part of the wager is tied to the election made by the player on the separate part of the wager is itself novel. The use of that wagering structure in combination with certain pseudo-pooling payout outcomes at the table is a further advance in the structure of wagering and play at casino table card games.

An example of the additional wagering structure and alternative payout structures include the use of excess retention by the house because of the unique wagering structure described above in the four-part wager (e.g., retaining a pair of 10's or other rank higher than 6's, 7's, 8's, or 9's as the winning hand) or by providing the option of a side bet to enter the additional award structure described below. Once the player is entered into the additional award structure (either automatically or with the optional or required side bet), the payout can be altered as follows. Those players that are entered into play of the additional award structure can participate in winning awards at the table, even where the awards occur in different hands, that is, hands of other players.

In present table gaming with bonuses or jackpots with side wagers, only the player receiving the hand is paid on the achievement of the bonus hand of at least a predetermined rank. In some poker clubs, certain events are paid both to players at the table and to the winning player from a pool when certain unusual events occur. For example, house rake may be partially deposited in a pool account Where when the event occurs, the pool is paid to the table where it occurs and the money in the pool is distributed proportionally. Such a situation would occur where, for example, the winning event in a pool was where a losing hand at a card table was at least a full house with at least three Aces and two 10's as the losing hand. The pool is distributed among the players and the sometimes the dealer at the table as, for example (70% to the winning hand, 10% to the losing hand and 20% to the remaining players at the table; or 70% to the winning hand, 15% to the second place hand, 20% to the remaining players at the table, and 5% to the dealer). The pool is a form of progressive jackpot which is incremented according to discretionary rules of the poker club or casino. All players at the table partake of the pool winnings if they anted in the play of the hand where the winning event occurred. No distinct side wager or particular wagering element is required to enter into the chance to win the pool, which occurs with only a single specific event occurring, as described.

In the practice of the present invention, accruing take from the third wager (automatically entering the player in the bonus event during the game) or preferably requiring a separate side wager to enter the bonus payout event is used to enable a player to enter the bonus event. The player is either required to place a side bet or has the option of placing a side bet to enter the bonus event. The bonus event is played against a pay table, whereby whenever any player at the table achieves a hand of predetermined rank, all players that are entered into the bonus event (either automatically or by placing the side bet) partakes of the bonus award for the predetermined hand. The rules may vary, so that a) only players that made the side bet wager can participate in the bonus, b) only players that made the side bet wager and remain in the game at the end of the hand can participate in the bonus, c) only players that made the side bet wager and have a qualifying hand can participate in the bonus, or d) only players that made the side bet wager and have a hand that beats the dealer's hand can participate in the bonus. The preferred method of play is a). The play of this bonus event with side bet can even be extended to include multiple tables. For example, certain progressive jackpot games link tables for the jackpot or bonus awards taken out of the jackpot pool. The tables can be linked by having players who had made the side bet wager at a distal table in the last hand before the bonus event was won at a proximal table. This is not a preferred embodiment (because of potential complexities in synchronization of play or debating when hands were played relative to distal side bets), but is within the skill of play and design. Additionally, the bonus may be paid either when any hand at the table achieves the predetermined hand rank, or only when a player that has made a side bet achieves a hand of the predetermined rank. The second format is preferred to stimulate more persons at the table to make the wager.

An aspect of this pay structure is to increase the frequency of bonus events at a table. With more players at a table, there are more hands per game at the table, and the hit frequency of bonus hands increases. Even though the actual size of individual awards per player decreases, the increased frequency improves the overall ambiance of the game. For example, if there are six players at a table, the frequency of bonus hands statistically increases to six times what the frequency was with a single player at the table.

The payouts for each player will necessarily vary according to the number of players that are in the game and/or have made the side bonus bet. The house may require a minimum number of players to engage play of this side bet bonus event, primarily to limit the number of pay tables that must be displayed It is also possible to have a display device (e.g., screen, monitor LED, liquid crystal display, plasma screen, etc.) that is fed by data from a computer or microprocessor or other image source to show the applicable pay table for the number of players involved in the payout for the hands. For example, the display may show separate screen for 2 player, 3 player, 4 player, 5 player, 6 player and 7 player bonus events, each screen having different odds and payouts. Automated equipment indicating the number of wagers placed, the number of players entered, the rank of the hand, and other factors can be provided. For example, camera, scanners, digital readers, and software interpreting the data such as that provided in U.S. Pat. Nos. 6,313,871; 6,460,848; 6,126,166; 5,941,769; and the like could be used to assist in automating the reading of cards, ranks, wagers, and the number of players.

It is also possible for players to elect to play a "double bonus." In this format, rather than a typical one dollar side bet being placed, two separate one dollar wagers or a single two dollar wager may be placed to enter the player in both an individual bonus payout event and the shared bonus event discussed above. Except where the bonus was a progressive bonus, this system could be highly attractive to players. The rules must be clear in the event that a progressive jackpot is used, so that it would be understood that a 100% jackpot win by a player with both side bets placed would win 50% of the total jackpot for him/herself, and the remaining 50% would be split among players in the bonus event, including the winning player. With a fixed bonus pay table, one of five players at a table with both side bets having been placed (the individual bonus and the shared bonus or group bonus wager) would receive a payment of the fixed amount for obtaining a predetermined rank hand and $1/5^{th}$ of the award for the group award on the ranked hand. For example, if the ranked hand were a Straight Flush with a $2,000 fixed award, the player with that hand would win $2,400-$2,000 for the individual bonus side bet and $1/5^{th}$ of $2,000 ($400) for the group bonus wager.

The side bets may be made on sensing systems or by placing tokens, chips or money on the table that remain on the table at appropriate locations until conclusion of the game. Typical sensing devices include coin drops, photooptical sensors, proximity detectors, cameras, scales, and the like.

The format of this game is particularly compatible with any poker-type games where bonus awards are provided from a pay table, such as Let It Ride® stud poker, Three Card™ poker, Four Card poker, 3-5-7™ Poker table game, and the like. It is also useful in games where progressive jackpots are used, alone or in combination with pay tables, such as with certain formats of Caribbean Stud™ poker. The wager could also be used in games where there are special bonuses given to players who obtain unique hands. For example, in Pai Gow poker, there may be special awards for perfect Pai Gow hands (e.g., 9, 8, 7, 5, 4, 3 and 2) or uniquely ranked hands (e.g., a front pair of aces and at least four-of-a-kind on the rear hand). The payouts could be made to all players participating in the wager (e.g., on a proportional basis), rather than just to the player who obtains the hand. The bonus wager could also be doubled so that a player could receive both the individual award and the group award for the hand.

The present invention may be embodied in other specific forms without departing from the essential attributes thereof. It is desired that the embodiments described above may be considered in all respects as illustrative, not restrictive, reference being made to the appended claims to indicate the scope of the invention.

What is claimed:

1. A method of playing a wagering game with multiple players, comprising: at least two players making a wager to participate in a casino card game; the at least two players making an optional wager to participate in a side bet game; distributing cards to the at least two players according to the rules of the game; resolving play of the casino card game; and resolving play of the side bet game according to rules of the side bet game, wherein all players making the optional wager in the side bet game share a pot with the pot comprising a predetermined payout amount based on a paytable for predetermined winning hands when one player wins according to the rules of the side bet game.

2. The method of claim 1, wherein the rules of the casino card game include playing for predetermined winning poker hands.

3. The method of claim 1, wherein the rules of the side bet game includes playing for a plurality of predetermined winning poker hands.

4. The method of claim 2, wherein the rules of the side bet game includes each player who made the second wager receiving an equal portion of the predetermined payout.

5. The method of claim 1 wherein a dealer distributes the cards to the at least two players.

6. The method of claim 5 wherein the dealer also deals cards to a dealer position for play in the casino card game.

7. The method of claim 1 wherein the casino card game comprises player hand rank comparison to a pay table.

8. The method of claim 1 wherein the casino card game comprises player hand competition against a dealer's hand.

9. The method of claim 1 wherein the casino card game comprises player hand competition against other player's hands.

10. The method of claim 1 wherein the pot is shared only when the player who wins according to the rules of the side bet game has made the optional wager.

11. The method of claim 1 wherein the pot is shared whether or not the player who wins according to the rules of the side bet game has made the optional wager.

12. The method of claim 1 wherein the pot is a progressive pot.

13. A method of playing a wagering game with multiple players, comprising: at least two players making a wager to participate in a casino card game; the at least two players making a mandatory wager to participate in a side bet game; distributing cards to the at least two players according to the rules of the game; resolving play of the casino card game; and resolving play of the side bet game according to rules of the side bet game, wherein all players making the mandatory wager in the side bet game share a pot with the pot comprising a predetermined payout amount based on a paytable for predetermined winning hands when one player wins according to the rules of the side bet game.

14. The method of claim 13 wherein the pot is shared only when the player who wins according to the rules of the side bet game has made the mandatory wager.

15. The method of claim 13 wherein the pot is shared whether or not the player who wins according to the rules of the side bet game has made the mandatory wager.

16. The method of claim 1 wherein the share is a proportional share of the pot.

17. The method of claim 16 wherein the proportional share includes a first percentage to the one player that wins and an even division of remaining percentage of the pot after payment to the one player that wins of the first percentage.

18. The method of claim 16 wherein the proportion share includes a first percentage to the one player that wins, a second percentage to a player with a second highest hand and an even division of remaining percentage of the pot after payment of the first percentage and the second percentage.

19. The method of claim 13 wherein the share is a proportional share of the pot.

20. The method of claim 19 wherein the proportional share includes a first percentage to the one player that wins and an even division of remaining percentage of the pot after payment to the one player that wins of the first percentage.

21. The method of claim 19 wherein the proportion share includes a first percentage to the one player that wins, a second percentage to a player with a second highest hand and an even division of remaining percentage of the pot after payment of the first percentage and the second percentage.

22. A method of playing a wagering game with multiple players, comprising:

at least two players making a wager to participate in a casino card game;

the at least two players making a wager to participate in a side bet game;

distributing cards to the at least two players according to the rules of the game;

resolving play of the casino card game; and resolving play of the side bet game according to rules of the side bet game, wherein all players making the wager in the side bet game share a pot based on a paytable payout when one player wins according to the rules of the side bet game.

23. The method of claim 22, wherein each player that made the wager when one player is declared a winner according to the rules of the side bet game shares equally in the paytable payout.

* * * * *